US011600211B2

(12) United States Patent
Kim

(10) Patent No.: US 11,600,211 B2
(45) Date of Patent: Mar. 7, 2023

(54) IMAGE DISPLAY APPARATUS AND METHOD THEREOF

(71) Applicant: LG ELECTRONICS INC., Seoul (KR)

(72) Inventor: Hyoyeong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 36 days.

(21) Appl. No.: 17/138,402

(22) Filed: Dec. 30, 2020

(65) Prior Publication Data

US 2021/0201726 A1 Jul. 1, 2021

(30) Foreign Application Priority Data

Dec. 30, 2019 (KR) ..... PCT/KR2019/018727

(51) Int. Cl.
*G09G 3/00* (2006.01)

(52) U.S. Cl.
CPC ..... *G09G 3/035* (2020.08); *G09G 2340/0442* (2013.01); *G09G 2380/02* (2013.01)

(58) Field of Classification Search
CPC ..... G09G 3/035; G09G 2340/0442; G09G 2380/02; G09G 3/20; G09G 3/34; G09G 3/36; H04N 21/462; H04N 21/422
See application file for complete search history.

(56) References Cited

U.S. PATENT DOCUMENTS

2014/0218375 A1* 8/2014 Kim ..... G06F 3/0488 345/501
2019/0286194 A1* 9/2019 Xia ..... G06F 1/1652

FOREIGN PATENT DOCUMENTS

| | | |
|---|---|---|
| JP | 2016510140 | 4/2016 |
| KR | 1020090071683 | 7/2009 |
| KR | 1020130055259 | 5/2013 |
| KR | 1020180134236 | 12/2018 |
| KR | 1020190082565 | 7/2019 |

OTHER PUBLICATIONS

PCT International Application No. PCT/KR2019/018727, Search Report dated Sep. 21, 2020, 3 pages.

* cited by examiner

*Primary Examiner* — Robert J Michaud
(74) *Attorney, Agent, or Firm* — Lee, Hong, Degerman, Kang & Waimey PC

(57) ABSTRACT

An image display apparatus includes: a housing; a display for displaying an image; a driving unit configured to change a size of a display area exposed to the outside of the housing among an entire area of the display; and a controller, wherein the controller determines whether an image displayed through at least a portion of the display area is a static image, when the size of the display area is smaller than the size of the entire area, determines whether the image is displayed for a certain time or longer, when the image is the static image, controls the driving unit to change the size of the display area, when the image is displayed for the certain time or longer, and controls the display so that the image is displayed in response to a degree of change in the size of the display area.

16 Claims, 17 Drawing Sheets

IMAGE DISPLAY APPARATUS AND METHOD THEREOF

CROSS-REFERENCE TO RELATED APPLICATION

Pursuant to 35 U.S.C. § 119 (a), this application claims the benefit of an earlier filing date and right of priority to International Application No. PCT/KR2019/018727 filed on Dec. 30, 2019, the contents of which are hereby incorporated by reference herein in its entirety.

BACKGROUND OF THE INVENTION

1. Field of the Invention

The present disclosure relates to an image display apparatus and a method of operating the same.

2. Description of the Related Art

An image display apparatus is a device having a function of displaying an image that can be viewed by a user. In recent years, with the development of the information society, as the demand for image display apparatus has increased in various forms, various image display apparatuses, such as Liquid Crystal Display apparatus (LCD), Plasma Display Panel (PDP), Electro luminescent Display (ELD), Vacuum Fluorescent Display (VFD), and the like, have been researched and used.

Among them, an image display apparatus using an organic light emitting diode (OLED) has the advantage of being implemented in an ultra-thin type, because it has excellent luminance characteristic and viewing angle characteristic in comparison with an image display apparatus such as an LCD, and does not require a backlight unit.

In addition, since a flexible display panel can be bent or wound around a roller, an image display apparatus wound around or unfolded from a roller can be implemented by using the flexible display panel.

Meanwhile, when a static image such as an image is displayed on the screen of the image display apparatus for a long time, it is highly possible that the afterimage of the static image does not disappear and remains intactly due to deterioration of elements constituting a display panel. Accordingly, there is a problem in that it is difficult to provide a clear image to a user, and the timing of repair and replacement of image display apparatus is getting faster.

SUMMARY OF THE INVENTION

The present disclosure has been made in view of the above problems, and provides an image display apparatus capable of preventing the occurrence of an afterimage on a screen and a method of operating the same.

In accordance with an aspect of the present disclosure, an image display apparatus includes: a housing; a display for displaying an image; a driving unit configured to change a size of a display area exposed to the outside of the housing among an entire area of the display; and a controller, wherein the controller determines whether an image displayed through at least a portion of the display area is a static image, when the size of the display area is smaller than the size of the entire area, determines whether the image is displayed for a certain time or longer, when the image is the static image, controls the driving unit to change the size of the display area, when the image is displayed for the certain time or longer, and controls the display so that the image is displayed in response to a degree of change in the size of the display area.

In accordance with another aspect of the present disclosure, a method of operating an image display apparatus includes: determining whether an image displayed through at least a portion of a display area is a static image, when a size of the display area of a display exposed to the outside of a housing is smaller than a size of an entire area of the display; determining whether the image is displayed for a certain time or longer, when the image displayed through at least a portion of the display area is the static image; changing the size of the display area, when the image is displayed for the certain time or longer; and displaying the image in response to a degree of the change in the size of the display area.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE PREFERRED EMBODIMENTS

Figure 1A:
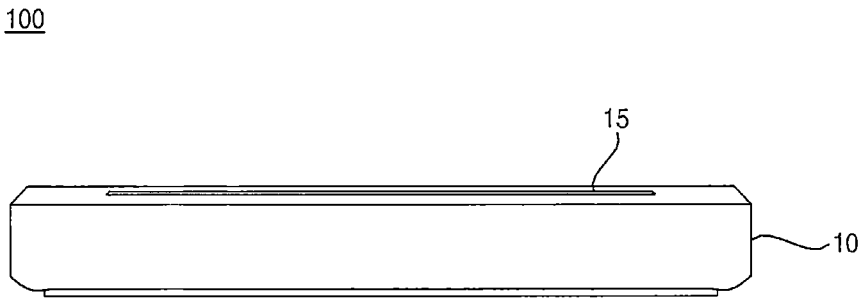
FIGS. 1A to 1C are diagrams illustrating an image display apparatus having a rollable display according to an embodiment of the present disclosure.

Hereinafter, the present disclosure will be described in detail with reference to the accompanying drawings. In order to clearly and briefly describe the present disclosure, components that are irrelevant to the description will be omitted in the drawings. The same reference numerals are used throughout the drawings to designate the same or similar components.

Terms "module" and "part" for elements used in the following description are given simply in view of the ease of the description, and do not carry any important meaning or role. Therefore, the "module" and the "part" may be used interchangeably.

It should be understood that the terms "comprise", "include", "have", etc. when used in this specification, specify the presence of stated features, integers, steps, operations, elements, components, or combinations of them but do not preclude the presence or addition of one or more other features, integers, steps, operations, elements, components, or combinations thereof.

It will be understood that, although the terms "first", "second", etc. may be used herein to describe various elements, these elements should not be limited by these terms. These terms are only used to distinguish one element from another element.

Unless otherwise defined, all terms including technical and scientific terms used herein have the same meaning as commonly understood by one of ordinary skill in the art to which the present disclosure belongs. Further, terms defined in a common dictionary will not be interpreted in an idealized or overly formal sense unless expressly so defined herein.

In the drawings, the thicknesses or the sizes of elements and graphs may be exaggerated, omitted or simplified to more clearly and conveniently illustrate the present disclosure.

Figure 1B:
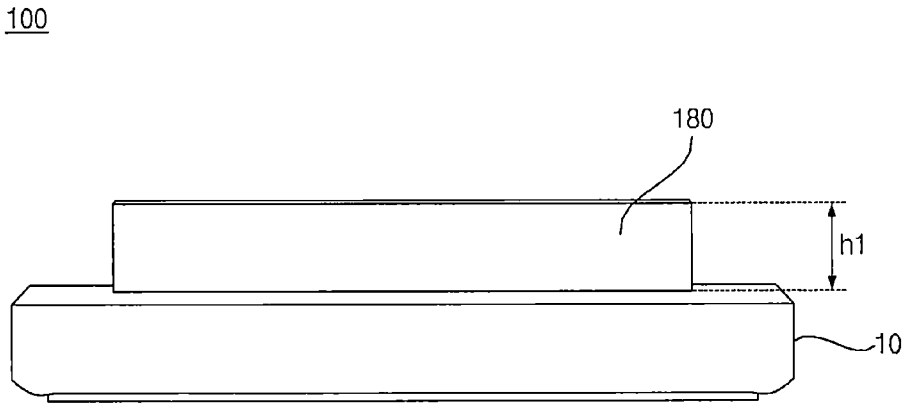
Figure 1C:
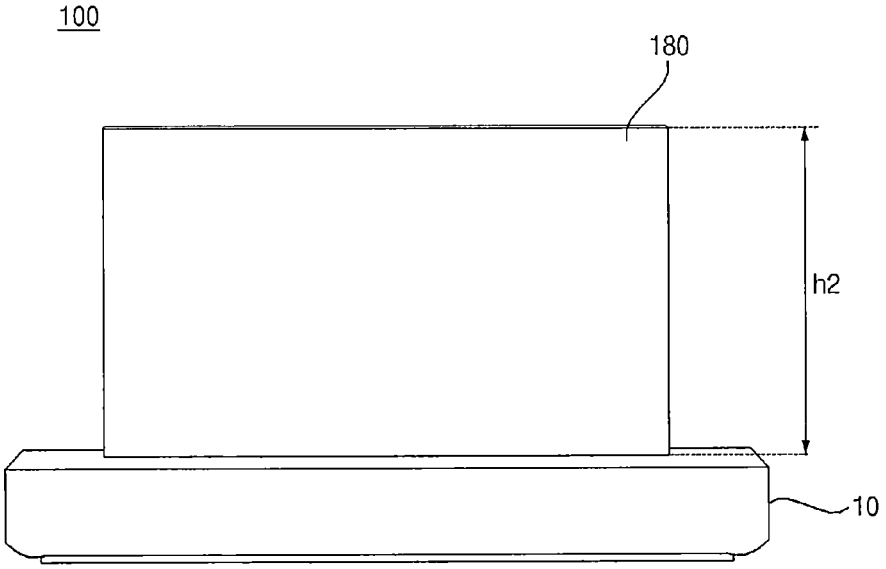

FIGS. 1A to 1C are diagrams illustrating an image display apparatus having a rollable display according to an embodiment of the present disclosure.

Referring to FIGS. 1A to 1C, an image display apparatus 100 may be an apparatus that processes and outputs an image. The image display apparatus 100 is not particularly limited as long as it can output a screen corresponding to an image signal, such as a TV, a notebook computer, a monitor, and the like.

The image display apparatus 100 may receive a broadcast signal, signal-process the broadcast signal, and output a signal-processed broadcast image. When the image display apparatus 100 receives a broadcast signal, the image display apparatus 100 may correspond to a broadcast reception device.

The image display apparatus 100 may receive a broadcast signal wirelessly through an antenna, or may receive a broadcast signal by wire through a cable.

For example, the image display apparatus 100 may receive a terrestrial broadcast signal, a satellite broadcast signal, a cable broadcast signal, an Internet Protocol Television (IPTV) broadcast signal, and the like.

The image display apparatus 100 may include a display 180 and a housing 10.

The housing 10 may have an inner space, and at least a portion of the display 180 may be positioned inside the housing 10.

An opening 15 may be formed on one surface of the housing 10, and at least a portion of the display 180 may be exposed to the outside of the housing 10 through the opening 15. In this case, the degree to which at least a portion of the display 180 is exposed to the outside of the housing 10 may be adjusted if necessary.

The display 180 may display an image. For example, the display 180 may display an image through at least a partial area exposed through the opening 15 among an entire area.

The display 180 may be a rollable display including a flexible display panel (not shown). For example, the display 180 may include an organic light emitting panel composed of an organic light emitting diode (OLED).

Inside the housing 10, a roller (not shown) which is wound around with a rollable display and a motor (not shown) for rotating the roller may be positioned. In this case, the display 180 may be rolled up or rolled down according to the rotation of the roller, and the size of the area exposed to the outside of the housing 10, among the entire area of the display 180, may be adjusted through the roll-up or roll-down of the display 180.

The image display apparatus 100 may adjust the size of an area exposed to the outside of the housing 10 among the entire area of the display 180, depending on a mode.

As shown in FIG. 1A, in the image display apparatus 100, the display 180 may be wound around the roller positioned inside the housing 10 so that the display 180 is not exposed to the outside of the housing 10 through the opening 150.

For example, when the power of the image display apparatus 100 is turned off or in a zero view mode, the display 180 is not exposed to the outside of the housing 10 through the opening 150, and power may not be supplied to the display 180. Here, the zero view mode may mean a mode in which the display 180 is not exposed to the outside of the housing 10 and only some component (e.g. the audio output unit 185 of FIG. 2) of the image display apparatus 100 operates.

Meanwhile, as shown in FIG. 1B, the display 180 is rolled up according to the rotation of the roller, so that the area corresponding to a first height h1, among the entire area of the display 180, may be exposed to the outside of the housing 10. In this case, the area corresponding to the first height h1 may correspond to a partial area of the display 180.

For example, when the image display apparatus 100 is in a line view mode, an image may be displayed through the area corresponding to the first height h1, which is exposed to the outside of the housing 10, among the entire area of the display 180. Here, the line view mode may mean a mode in which only a portion of the entire area of the display 180 is exposed to the outside of the housing 10.

Meanwhile, as shown in FIG. 1C, the display 180 is rolled up according to the rotation of the roller, so that an area corresponding to a second height h2, among the entire area of the display 180, may be exposed to the outside of the housing 10. In this case, the area corresponding to the second height h2 may correspond to the entire area of the display 180.

For example, in a full view mode, the image display apparatus 100 may display an image through the entire area of the display 180 exposed to the outside of the housing 10. Here, the full view mode may mean a mode in which the entire area of the display 180 is exposed to the outside of the housing 10.

Figure 2:
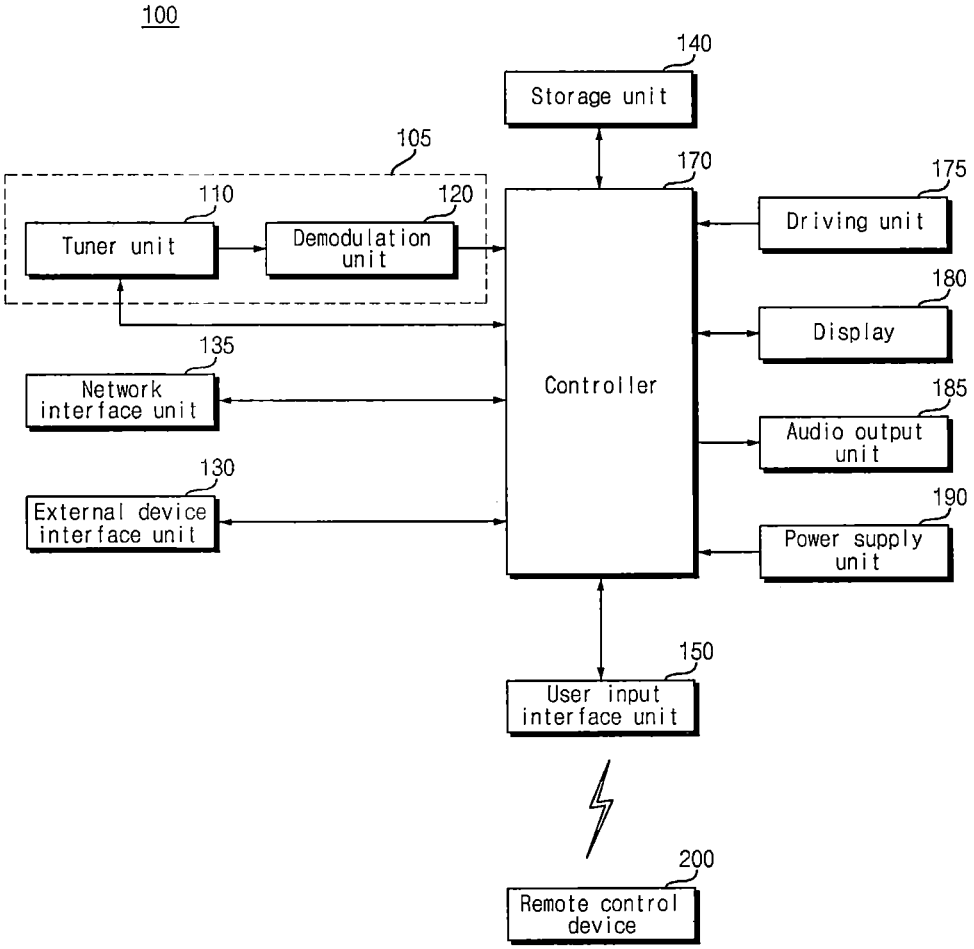
FIG. 2 is an internal block diagram of the image display apparatus of FIGS. 1A to 1C.

FIG. 2 is an internal block diagram of the image display apparatus of FIGS. 1A to 1C.

Referring to FIG. 2, the image display apparatus 100 may include a broadcast reception unit 105, an external device interface unit 130, a network interface unit 135, a storage unit 140, a user input interface unit 150, a controller 170, a driving unit 175, a display 180, an audio output unit 185 and/or a power supply unit 190.

The broadcast reception unit 105 may include a tuner unit 110 and a demodulation unit 120.

The tuner unit 110 may select a broadcast signal corresponding to a channel selected by a user or all previously stored channels from among broadcast signals received through an antenna (not shown) or a cable (not shown). The tuner unit 110 may convert the selected broadcast signal into an intermediate frequency signal, a baseband image, or an audio signal.

For example, if the selected broadcast signal is a digital broadcast signal, the tuner unit 110 may convert the digital broadcast signal into a digital IF signal (DIF). If the selected broadcast signal is an analog broadcast signal, the tuner unit 110 may convert the analog broadcast signal into an analog baseband image or audio signal (CVBS/SIF). That is, the tuner unit 110 may process a digital broadcast signal or an analog broadcast signal. The analog baseband image or audio signal (CVBS/SIF) output from the tuner unit 110 may be directly input to the controller 170.

Meanwhile, the tuner unit 110 may sequentially select broadcast signals of all broadcast channels stored through a channel memory function among received broadcast signals, and convert the broadcast signals into an intermediate frequency signal, a baseband image, or an audio signal.

Meanwhile, the tuner unit 110 may include a plurality of tuners in order to receive broadcast signals of a plurality of channels. Alternatively, a single tuner that simultaneously receives broadcast signals of a plurality of channels may be provided.

A demodulation unit 120 may perform a demodulation operation by receiving the digital IF signal DIF converted by the tuner unit 110.

The demodulation unit 120 may output a stream signal TS after performing demodulation and channel decoding. In this case, the stream signal may be a multiplexed signal of an image signal, an audio signal, or a data signal.

The stream signal output from the demodulation unit 120 may be input to the controller 170. After performing demultiplexing, image/audio signal processing, and the like, the controller 170 may output an image through the display 180 and output an audio through the audio output unit 185.

The external device interface unit 130 may transmit or receive data with a connected external device. To this end, the external device interface unit 130 may include an A/V input/output unit (not shown).

The external device interface unit 130 may be connected to an external device such as a digital versatile disk (DVD), a Blu ray, a game device, a camera, a camcorder, a computer (laptop), a set-top box, or the like by wire/wireless, and may perform input/output operations with the external device.

An A/V input/output unit may receive image and audio signals from an external device.

In addition, the external device interface unit 130 establishes a communication network with various remote control devices 200 as shown in FIG. 1, and may receive a control signal related to the operation of the image display apparatus 100 from the remote control device 200, or may transmit data related to the operation of the image display apparatus 100 to the remote control device 200.

The external device interface unit 130 may include a communication module (not shown) for short-range wireless communication with other electronic device.

Through such a wireless communication unit (not shown), the external device interface unit 130 may transmit and receive data with an adjacent electronic device. In particular, in a mirroring mode, the external device interface unit 130 may receive device information, executed application information, application image, and the like from a mobile terminal.

The network interface unit 135 may provide an interface for connecting the image display apparatus 100 to a wired/wireless network including an Internet network. For example, the network interface unit 135 may receive content or data provided by the Internet, a content provider, or a network operator, through a network.

Meanwhile, the network interface unit 135 may include a communication module (not shown) for connection with a wired/wireless network.

For example, the external device interface unit 130 and/or the network interface unit 135 may include a communication module for short-range communication such as Wireless Fidelity (Wi-Fi), Bluetooth, Bluetooth Low Energy (BLE), Zigbee, and Near Field Communication (NFC), and a communication module for cellular communication such as long-term evolution (LTE), LTE Advance (LTE-A), code division multiple access (CDMA), wideband CDMA (WCDMA), universal mobile telecommunications system (UMTS), Wireless Broadband (WiBro).

The storage unit 140 may store a program for processing and controlling each signal in the controller 170 or may store a signal-processed image, audio, or data signal.

For example, the storage unit 140 may store application programs designed for performing various tasks that can be processed by the controller 170, and may provide some of the stored application programs selectively when requested by the controller 170.

Program, or the like stored in the storage unit 140 is not particularly limited as long as they can be executed by the controller 170.

The storage unit 140 may perform a function for temporary storage of an image, audio, or data signal received from an external device through the external device interface unit 130.

The storage unit 140 may store information on a certain broadcast channel, through a channel memory function such as a channel map.

The storage unit 140 may store various data received through the external device interface unit 130, the network interface unit 135, and/or the user input interface unit 150.

FIG. 2 illustrates an embodiment in which the storage unit 140 is provided separately from the controller 170, but the scope of the present disclosure is not limited thereto, and the storage unit 140 may be included in the controller 170.

The user input interface unit 150 may transmit a signal input by the user to the controller 170, or may transmit a signal from the controller 170 to the user.

For example, the user input interface unit 150 may transmit/receive a user input signal such as power on/off, channel selection, and screen setting, from the remote control device 200, transmit a user input signal input from a local key (not shown) such as a power key, a channel key, a volume key, a setting key, and the like provided in the image display apparatus 100 to the controller 170, transmit a user input signal input from a sensor unit (not shown) that senses a user's gesture to the controller 170, or transmit a signal from the controller 170 to the sensor unit.

The controller 170 may include at least one processor, and may control the overall operation of the image display apparatus 100 by using the processor included therein. Here, the processor may be a general processor such as a central processing unit (CPU). Obviously, the processor may be a dedicated device such as an ASIC or another hardware-based processor.

The controller 170 may demultiplex the stream input through the tuner unit 110, the demodulation unit 120, the external device interface unit 130, or the network interface unit 135, or may generate and output a signal for image or audio output by processing demultiplexed signals.

The display 180 may generate a driving signal by converting the data signal, the OSD signal, the control signal, the image signal processed by the controller 170, or the data signal, the control signal, the image signal received from the external device interface unit 130, or the like.

The display 180 may include a display panel (not shown) including a plurality of pixels.

A plurality of pixels provided in a display panel may include a RGB subpixel. Alternatively, a plurality of pixels provided in a display panel may include a RGBW subpixel.

The display 180 may generate a driving signal for a plurality of pixels, by converting the image signal, the data signal, the OSD signal, the control signal, and the like processed by the controller 170.

The display 180 may be a Plasma Display Panel (PDP), a Liquid Crystal Display (LCD), an Organic Light Emitting Diode (OLED), a flexible display, or the like and may also be a 3D display. The 3D display 180 may be classified into a glasses-free type and a glasses type.

Meanwhile, the display 180 may be configured as a touch screen and used as an input device in addition to an output device.

The driving unit 175 may include a roller (not shown) which is wound around with a display 180 and a motor (not shown).

The display 180 may be wound around or unfolded from the roller according to an operation of the motor.

The audio output unit 185 receives a signal audio-processed by the controller 170 and outputs it as an audio.

The image signal processed by the controller 170 may be input to the display 180 and may be displayed as an image corresponding to a pertinent image signal. In addition, the image signal processed by the controller 170 may be input to the external output device through the external device interface unit 130.

The audio signal processed by the controller 170 may be output to the audio output unit 185 as an audio. In addition, the audio signal processed by the controller 170 may be input to an external output device through the external device interface unit 130.

Although not shown in FIG. 2, the controller 170 may include a demultiplexer, an image processing unit, and the like. This will be described later with reference to FIG. 3.

In addition, the controller 170 may control the overall operation of the image display apparatus 100.

For example, the controller 170 may control the tuner unit 110 to select (tune) a channel selected by a user or a broadcast corresponding to a previously stored channel.

In addition, the controller 170 may control the image display apparatus 100 according to a user command input through the user input interface unit 150 or an internal program.

Meanwhile, the controller 170 may control the display 180 to display an image. In this case, the image displayed on the display 180 may be a still image or a moving image, and may be a 2D image or a 3D image.

Meanwhile, the controller 170 may display a certain 2D object within an image displayed on the display 180. For example, the object may be at least one of an accessed web screen (newspaper, magazine, etc.), an electronic program guide (EPG), various menus, widget, icon, still image, moving image, and text.

Meanwhile, the image display apparatus 100 may further include a photographing unit (not shown). The photographing unit may photograph a user. The photographing unit may be implemented with one camera, but is not limited thereto, and may be implemented with a plurality of cameras. Meanwhile, the photographing unit may be embedded in the image display apparatus 100 in an upper portion of the display 180 or may be separately disposed. Image information photographed by the photographing unit may be input to the controller 170.

The controller 170 may determine a user's position, based on the image photographed by the photographing unit. For example, the controller 170 may determine a distance (z-axis coordinate) between the user and the image display apparatus 100. In addition, the controller 170 may determine the x-axis coordinates and the y-axis coordinates in the display 180 corresponding to the user position.

The controller 170 may detect a user's gesture based on the image photographed by the photographing unit, each of signals detected by the sensor unit, or a combination thereof.

Meanwhile, the controller 170 may transmit and receive a short-range communication signal through the external device interface unit 130. For example, the controller 170 may transmit and receive a BLE signal through a Bluetooth low power (BLE) communication module provided in the external device interface unit 130.

The controller 170 may calculate the signal strength of the received short-range communication signal. For example, the controller 170 may calculate a Received Signal Strength Indication (RSSI) value of the received short-range communication signal. In this case, the controller 170 may determine a distance to a device that outputs the short range communication signal, in response to the RSSI value of the short range communication signal.

Meanwhile, the controller 170 may communicate with an AP 20, through the network interface unit 135. The controller 170 may transmit/receive data to/from devices connected to the communication network 30 or access to the Internet, through the communication network 30 provided by the AP 20.

For example, the controller 170 may transmit a control command to devices connected to the communication network 30, and receive data on the processing result of control command from devices connected to the communication network 30, through the network interface unit 135.

The power supply unit 190 may supply corresponding power throughout the image processing apparatus 100. In particular, the power supply unit 190 may supply power to the controller 170 that can be implemented in the form of a System On Chip (SOC), the display 180 for displaying an image, the audio output unit 185 for outputting audio, and the like.

Specifically, the power supply unit 190 may include a converter (not shown) for converting AC power into DC power, and a Dc/Dc converter (not shown) for converting the level of DC power.

Meanwhile, the image display apparatus 100 may further include an input unit (not shown). The input unit may be provided in one side of a main body of the image display apparatus 100. For example, the input unit may include a touch pad, a physical button, and the like.

The input unit may receive various user commands related to the operation of the image display apparatus 100 and may transmit a control signal corresponding to the input command to the controller 170.

Meanwhile, the image display apparatus 100 may be a fixed or mobile digital broadcasting receiver capable of receiving digital broadcasting.

Meanwhile, the block diagram of the image display apparatus 100 shown in FIG. 2 is just a block diagram for an embodiment of the present disclosure, and each component of the block diagram can be combined, added, or omitted in accordance with the specifications of the image display apparatus 100 that is actually implemented.

That is, if necessary, two or more components may be combined into a single component, or one component may be subdivided into two or more components. In addition, the functions performed in each block are for explaining the embodiment of the present disclosure, and a specific operation or device thereof does not limit the scope of the present disclosure.

The remote control device 200 may include various communication modules such as Wireless Fidelity (Wi-Fi), Bluetooth, Bluetooth Low Power (BLE), Zigbee, and Near Field Communication (NFC).

The remote control device 200 may transmit a user command to the user input interface unit 150 through the communication module.

In addition, the remote control device 200 may receive the image, audio, or data signal output from the user input interface unit 150 through the communication module, and display on the remote control device 20 or output as an audio.

Meanwhile, the remote control apparatus 200 may communicate with the AP 20 through the communication module. For example, the remote control device 200 may transmit/receive data to and from external devices connected to the communication network 30 through the communication network 30 provided by the AP 20.

Figure 3:
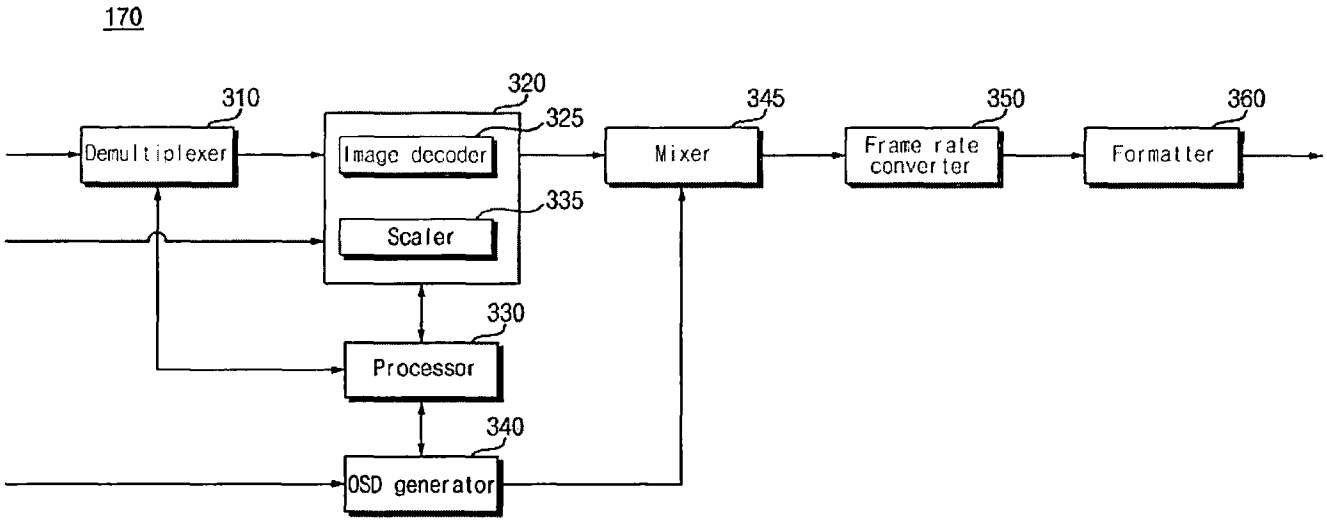
FIG. 3 is an internal block diagram of a controller of FIG. 2.

FIG. 3 is an internal block diagram of a controller of FIG. 2.

Referring to FIG. 3, the controller 170 according to an embodiment of the present disclosure may include a demultiplexer 310, an image processing unit 320, a processor 330, an OSD generator 340, a mixer 345, a frame rate converter 350, and/or a formatter 360. In addition, an audio processing unit (not shown) and a data processing unit (not shown) may be further included.

The demultiplexer 310 may demultiplex an input stream. For example, when an MPEG-2 TS is input, it can be demultiplexed and separated into image, audio, and data signal, respectively. Here, the stream signal input to the demultiplexer 310 may be a stream signal output from the tuner unit 110, the demodulation unit 120, or the external device interface unit 130.

The image processing unit 320 may perform image processing of the demultiplexed image signal. To this end, the image processing unit 320 may include an image decoder 325 and a scaler 335.

The image decoder 325 may decode the demultiplexed image signal, and the scaler 335 may perform scaling so that the resolution of the decoded image signal can be output from the display 180.

The image decoder 325 may include decoders of various standards. For example, the image decoder 325 may include an MPEG-2, H.264 decoder, a 3D image decoder for color image and depth image, a decoder for multiple view images, and the like.

The processor 330 may control overall operation within the image display apparatus 100 or within the controller 170. For example, the processor 330 may control the tuner unit 110 to select (tune) a broadcast corresponding to a channel selected by a user or a previously stored channel.

In addition, the processor 330 may control the image display apparatus 100 by a user command input through the user input interface unit 150 or an internal program.

In addition, the processor 330 may control data transmission with the network interface unit 135 or the external device interface unit 130.

Further, the processor 330 may control operation of the demultiplexer 310, the image processing unit 320, and the OSD generator 340 in the controller 170.

The OSD generator 340 may generate an OSD signal by itself or according to a user input. For example, the OSD generator 340 may generate a signal for displaying various types of information on the screen of the display 180 as a graphic or text, based on a user input signal input through the input unit 160.

The generated OSD signal may include various data such as a user interface screen, various menu screens, widgets, icons, and the like of the image display apparatus 100. In addition, the generated OSD signal may include a 2D object or a 3D object.

In addition, the OSD generator 340 may generate a pointer that can be displayed on the display 180, based on a pointing signal input from the remote control device 200.

The OSD generator 340 may include a pointing signal processing unit (not shown) that generates a pointer. The pointing signal processing unit (not shown) may not be provided in the OSD generator 340 and may be provided separately.

The mixer 345 may mix the OSD signal generated by the OSD generator 340 and the decoded image signal image-processed by the image processing unit 320. The mixed image signal may be provided to the frame rate converter 350.

The frame rate converter (FRC) 350 may convert a frame rate of an input image. Meanwhile, the frame rate converter 350 may output intactly without additional frame rate conversion.

The formatter 360 may arrange a left-eye image frame and a right-eye image frame of a frame rate-converted 3D image. In addition, the formatter 360 may output a synchronization signal Vsync for opening the left-eye glass and the right-eye glass of a 3D viewing device (not shown).

Meanwhile, the formatter 360 may convert the format of an input image signal into an image signal for display on the display 180 and output it.

In addition, the formatter 360 may change the format of the 3D image signal. For example, the formatter 360 may change the format of the 3D image signal into any one format among various 3D formats such as Side by Side format, Top/Down format, Frame Sequential format, Interlaced format, Checker Box format, and the like.

Meanwhile, the formatter 360 may convert a 2D image signal into a 3D image signal. For example, according to a 3D image generation algorithm, the formatter 360 may detect an edge or a selectable object in a 2D image signal, and separate and generate into a 3D image signal by the object according to the detected edge or the selectable object. At this time, the generated 3D image signal may be separated and arranged into a left-eye image signal L and a right-eye image signal R, as described above.

Meanwhile, although not shown in the drawing, after the formatter 360, a 3D processor (not shown) for processing a 3-dimensional (3D) effect signal may be further disposed. Such a 3D processor may process brightness, tint, and color adjustment of an image signal in order to improve a 3D effect. For example, it is possible to perform signal processing, or the like to make the near clear and the far blurry. Meanwhile, the functions of the 3D processor may be merged into the formatter 360 or within the image processing unit 320.

Meanwhile, an audio processing unit (not shown) in the controller 170 may perform audio processing of a demultiplexed audio signal. To this end, the audio processing unit (not shown) may include various decoders.

In addition, the audio processing unit (not shown) in the controller 170 may process a base, a treble, a volume control, and the like.

The data processing unit (not shown) in the controller 170 may perform data processing of the demultiplexed data signal. For example, when the demultiplexed data signal is an encoded data signal, it may be decoded. The encoded data signal may be electronic program guide information including broadcasting information such as a start time and an end time of a broadcast program aired on each channel.

Meanwhile, the block diagram of the controller 170 shown in FIG. 3 is just a block diagram for an embodiment of the present disclosure, and each component of the block diagram may be integrated, added, or omitted according to the specifications of the actually implemented controller 170.

In particular, the frame rate converter 350 and the formatter 360 are not provided in the controller 170, but may be separately provided respectively or may be provided separately as a single module.

Figure 4:
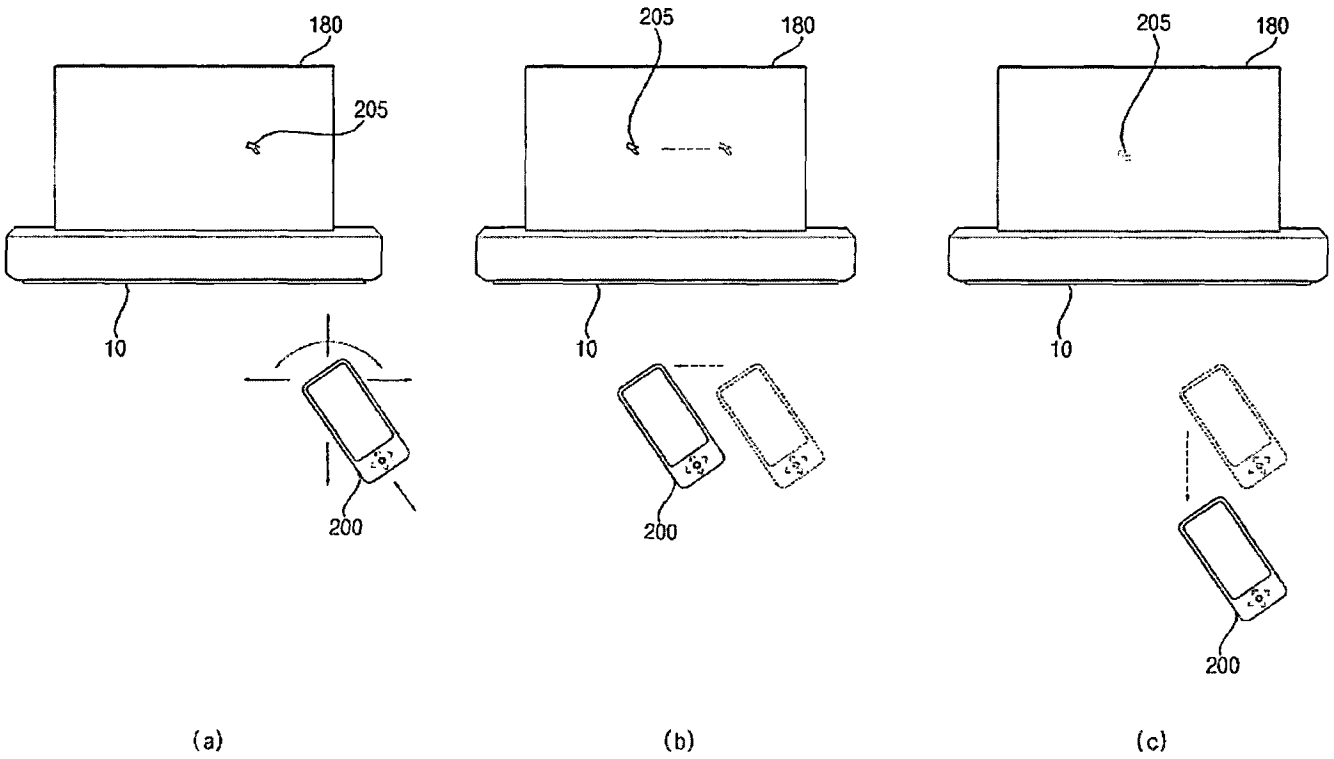
FIG. 4 is a diagram illustrating a method of controlling a remote control device of FIG. 2.

FIG. 4 is a diagram illustrating a method of controlling a remote control device of FIG. 2.

As shown in FIG. 4A, a pointer 205 corresponding to the remote control device 200 may be displayed on the display 180.

The user can move or rotate the remote control device 200 up and down, left and right (FIG. 4B), back and forth (FIG. 4C). The movement of the pointer 205 displayed on the display 180 of the image display apparatus may correspond to the movement of the remote control device 200. As shown in the drawing, the remote control device 200 may allow a corresponding pointer 205 to move and be displayed according to movement in a 3D space, and thus may be referred to as a space remote controller or a 3D pointing device.

FIG. 4B illustrates that when a user moves the remote control device 200 to the left, the pointer 205 displayed on the display 180 of the image display apparatus 100 also moves to the left in response thereto.

Information on the movement of the remote control device 200 detected through a sensor (not shown) of the remote control device 200 may be transmitted to the image display apparatus 100. The image display apparatus 100 may calculate the coordinate of the pointer 205 from information related to the movement of the remote control device 200. The image display apparatus 100 may display a pointer 205 to correspond to the calculated coordinates.

FIG. 4C illustrates a case in which a user moves the remote control device 200 away from the display 180 while pressing a specific button in the remote control device 200. Accordingly, the selection area in the display 180 corresponding to the pointer 205 may be zoomed-in to be displayed in an enlarged manner. On the other hand, when the user moves the remote control device 200 closer to the display 180, the selection area in the display 180 corresponding to the pointer 205 may be zoomed-out to be displayed in a reduced size.

Meanwhile, when the remote control device 200 moves away from the display 180, the selection area may be zoomed-out, and when the remote control device 200 approaches the display 180, the selection area may be zoomed-in.

Meanwhile, when a specific button in the remote control device 200 is pressed, the image display apparatus 100 may exclude the determination of the up, down, left and right movements of the remote control device 200. That is, when the remote control device 200 moves away from or approaches the display 180, the up, down, left, and right movements are not determined, but only forward and backward movements may be determined. When a specific button in the remote control device 200 is not pressed, only the pointer 205 may be moved and displayed according to the up, down, left, and right movements of the remote control device 200.

Meanwhile, the moving speed or moving direction of the pointer 205 may correspond to the moving speed or moving direction of the remote control device 200.

Figure 5:
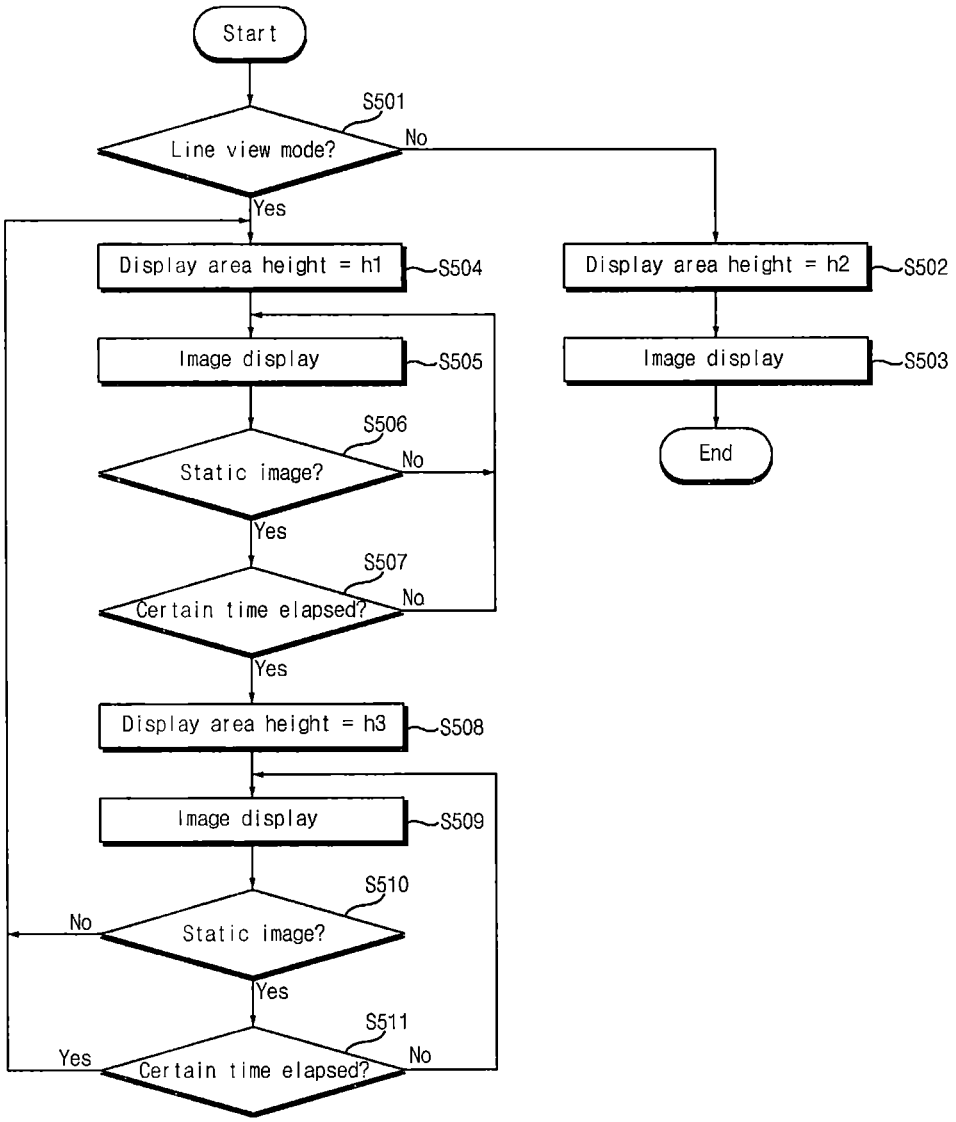
FIG. 5 is a flowchart illustrating a method of operating an image display apparatus according to an embodiment of the present disclosure.

FIG. 5 and FIG. 7 are flowcharts illustrating a method of operating an image display apparatus according to an embodiment of the present disclosure. FIGS. 6A, 6B, and 8A to 10 are diagrams for explaining a method of operating an image display apparatus.

Referring to FIG. 5, at operation S501, the image display apparatus 100 may check whether the mode of the image display apparatus 100 is the line view mode. For example, the image display apparatus 100 may determine a mode of the image display apparatus 100 according to a user input inputted through the user interface unit 150.

At operation S502, when the mode of the image display apparatus 100 is a full view mode rather than the line view mode, the image display apparatus 100 may control the driving unit 175 so that the height of the display area exposed to the outside of the housing 10 reaches a second height h2.

In this case, the second height h2 may be a height corresponding to the entire area of the display 180.

The image display apparatus 100 may display an image through the entire area of the display 180, at operation S503.

Figure 6A:
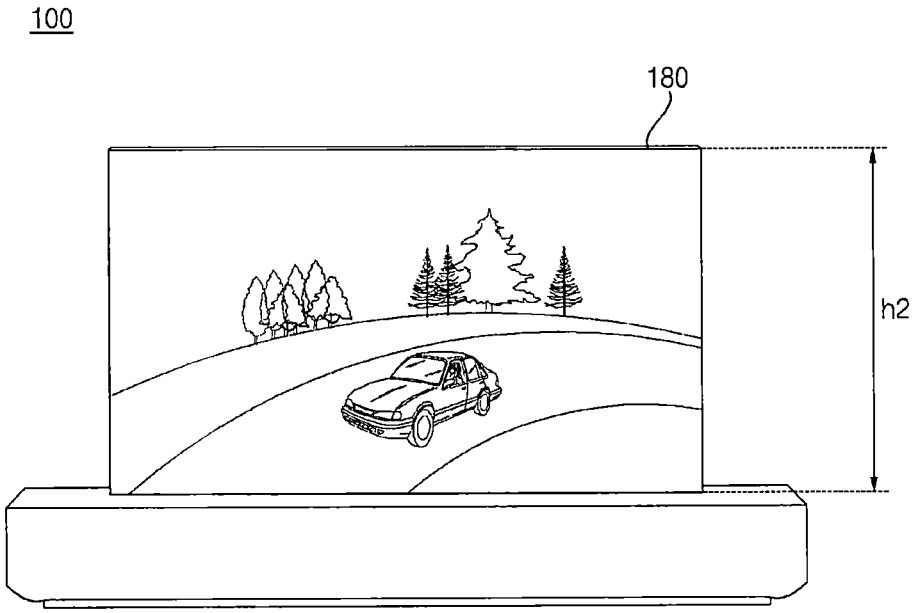
FIGS. 6A and 6B are diagrams for explaining a method of operating an image display apparatus.

Referring to FIG. 6A, when the mode of the image display apparatus 100 is a full view mode, the display 180 may display an image through a display area corresponding to the second height h2.

In this case, the image displayed through the display area corresponding to the second height h2 may be a static image or a dynamic image. Here, the static image may mean that the same image is continuously displayed in the display area without change, and the dynamic image may mean that the image is orderly changed in the display area.

Meanwhile, according to various embodiments of the present disclosure, at operation S502, when the mode of the image display apparatus 100 is a zero view mode rather than the line view mode, the image display apparatus 100 may control the driving unit 175 so that the display 180 is not exposed to the outside of the housing 10.

In addition, at operation S503, the image display apparatus 100 may output only audio through the audio output unit 185 without outputting an image through the display 180.

Referring to FIG. 5 again, at operation S504, when the mode of the image display apparatus 100 is the line view mode, the image display apparatus 100 may control the driving unit 175 so that the height of the display area exposed to the outside of the housing 10 can reach the first height h1. For example, the first height h1 may be a height corresponding to ⅓ of the second height h2.

The image display apparatus 100 may output an image through the display area corresponding to the first height h1, at operation S505.

The image display apparatus 100 may display a plurality of different images through the display area corresponding to the first height h1. In this case, the plurality of different images may all be a static image, or at least one of the plurality of different images may be a dynamic image.

Figure 6B:
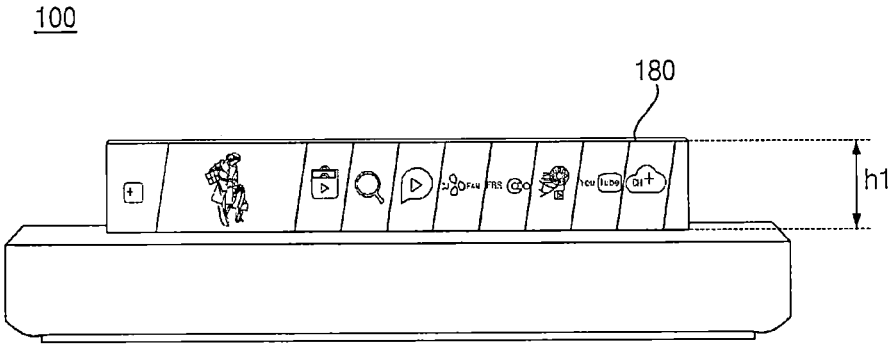

As shown in FIG. 6B, the image display apparatus 100 may display an application list including image for each of a plurality of applications. In this case, the image for each of the plurality of applications may be a static image or a dynamic image.

Referring to FIG. 5 again, at operation S506, the image display apparatus 100 may determine whether an image displayed in the display area corresponding to the first height h1 is a static image. In this case, if the image displayed in the display area corresponding to the first height h1 is not a static image, the image display apparatus 100 may branch to operation S505 and continue to display the image.

In other words, if the image displayed in the display area corresponding to the first height h1 is not a static image which has a high possibility of leaving afterimage, the image display apparatus 100 may continue to display the image. This will be described with reference to FIGS. 7A and 7B.

Figure 7A:
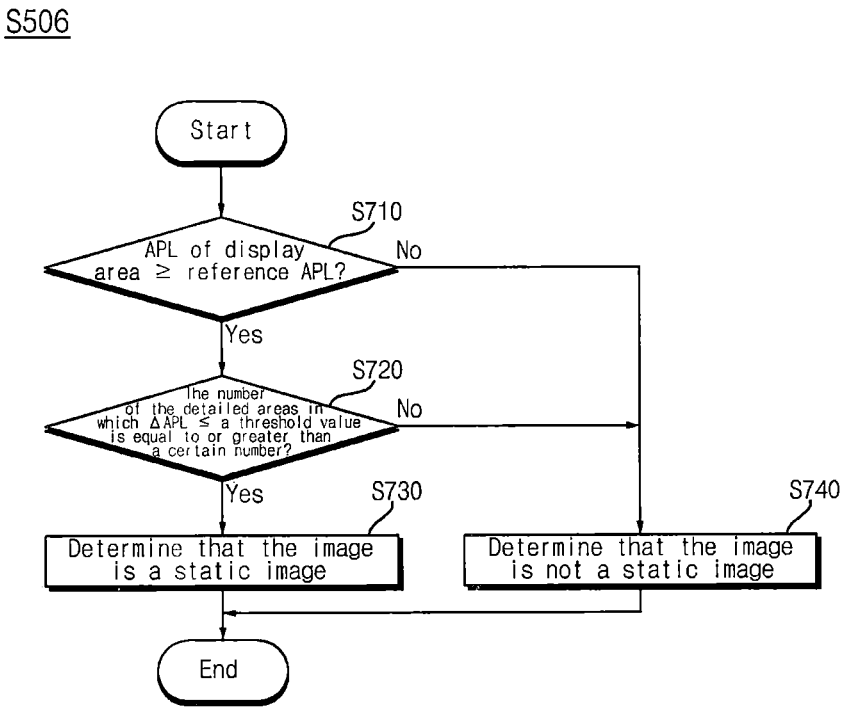
FIGS. 7A and 7B are flowcharts illustrating a detailed operation method relating to the method of operating the image display apparatus of FIG. 5.

First, referring to FIG. 7A, at operation S710, the image display apparatus 100 may calculate an average picture level APL for the display area which is exposed to the outside of the housing 10 to display an image among the display 180, and may determine whether the APL for the display area is greater than or equal to a reference APL (e.g. 50%). Here, the APL may mean an average of brightness of each part of a screen with respect to the maximum brightness of the screen, that is, the average brightness of an image displayed on the screen.

For example, the image display apparatus 100 may calculate an APL, based on RGB data for a frame of the image displayed in a display area corresponding to the first height h1.

Meanwhile, the image display apparatus 100 may calculate the APL for the entire display area which is exposed to the outside of the housing 10 to display an image and compare the calculated APL with a reference APL, and may calculate the APL for each of a plurality of detailed areas included in the display area and compare the calculated APL with the reference APL.

Figure 8A:
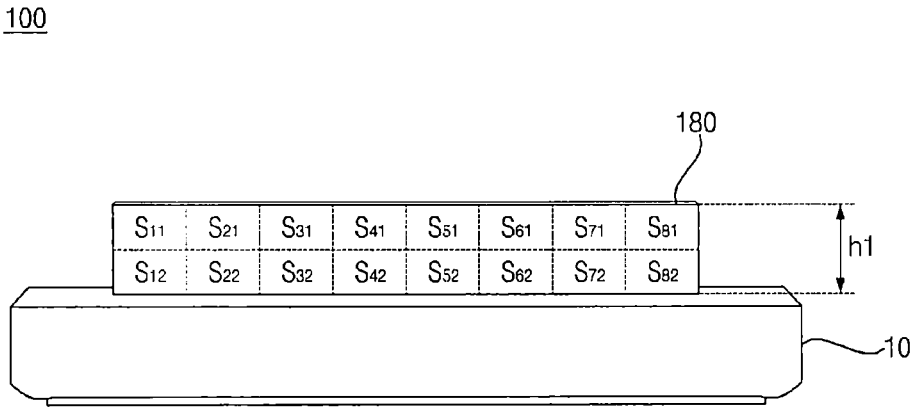
FIGS. 8A to 12B are diagrams for explaining a method of operating an image display apparatus.

As shown in FIG. 8A, the display area may include a plurality of detailed areas (S11 to S82). In the present drawing, it is illustrated that the display area includes 16 detailed areas (S11 to S82), but the present disclosure is not limited thereto.

Referring to FIG. 7A again, at operation S740, when the APL for all of the plurality of detailed areas is less than the reference APL, the image display apparatus 100 may determine that the image displayed in the display area is not a static image having a high possibility of leaving afterimage.

Alternatively, at operation S740, the image display apparatus 100 may compare the APL for each of a plurality of detailed areas with the reference APL (e.g. 50%). When there exist a certain number (e.g. 12) or more of the detailed areas less than the reference APL (e.g. 50%) among the plurality of detailed areas, the image display apparatus 100 may determine that the image displayed in the display area is not a static image having a high possibility of leaving afterimage.

Meanwhile, at operation S720, when the APL for the display area is greater than or equal to the reference APL, the image display apparatus 100 may calculate a first APL for each of a plurality of detailed areas included in the display area, and calculate a second APL according to a preset time or a preset frame.

In this case, the image display apparatus 100 may determine whether the number of the detailed areas having a difference (AAPL), between the first APL and the second APL, less than a threshold value (e.g. 5), which is calculated for each of a plurality of detailed areas included in the display area, is greater than or equal to a reference number (e.g. 10).

Meanwhile, when calculating the APL for each of a plurality of detailed areas at operation S710, the image display apparatus 100 may determine the APL calculated at operation S710 as the first APL, and may calculate only the second APL according to a preset time or a preset frame at operation S720.

At operation S730, when the number of the detailed areas having a difference (ΔAPL), between the first APL and the second APL, less than the threshold value is greater than or equal to the reference number, the image display apparatus 100 may determine that the image displayed in the display area is a static image having a high possibility of leaving afterimage.

Meanwhile, at operation S740, when the number of the detailed areas having a difference (ΔAPL), between the first APL and the second APL, less than the threshold value is less than the reference number, the image display apparatus 100 may determine that the image displayed in the display area is a static image having a high possibility of leaving afterimage.

Figure 8B:
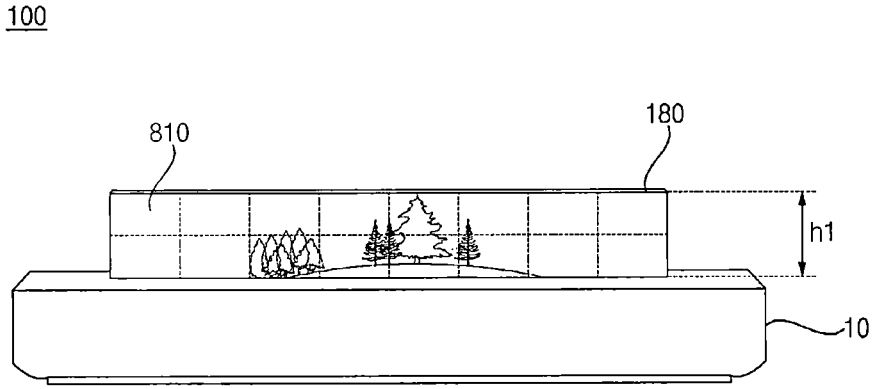

As shown in FIG. 8B, a single image 810 may be continuously displayed over the entire display area corresponding to the first height h1 of the display 180.

At this time, since the number of the detailed areas having a difference (ΔAPL), between the first APL and the second APL, less than the threshold value is greater than or equal to the reference number (e.g. 10), the image display apparatus 100 may determine that the image displayed in the display area is a static image having a high possibility of leaving afterimage.

Figure 8C:
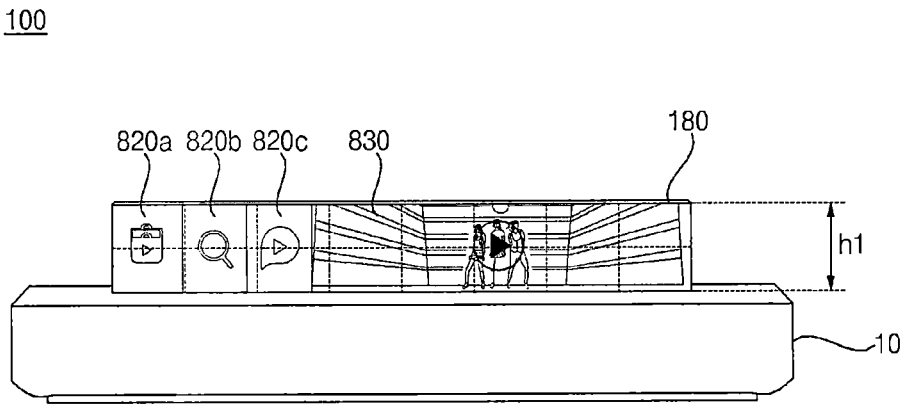

Meanwhile, as shown in FIG. 8C, images 820*a* to 820*c* may be displayed through a portion of the display area corresponding to the first height h1 of the display 180, and a moving image 830 may be displayed through the remaining portion.

When the image displayed in the area where the moving image 830 is displayed is continuously changed due to the playback of the moving image 830, the difference (ΔAPL) between the first APL and the second APL of a corresponding detailed area may be greater than or equal to the threshold value, and the number of the detailed areas having a difference (ΔAPL), between the first APL and the second APL, less than the threshold value in the display area may be less than the reference number (e.g. 10).

When the number of the detailed areas having a difference (ΔAPL), between the first APL and the second APL, less than the threshold value is less than the reference number (e.g. 10), due to the playback of the moving image 830, the image display apparatus 100 may determine that the image displayed in the display area is not a static image having a high possibility of leaving afterimage.

Meanwhile, when the difference ΔAPL between the first APL and the second APL of the detailed area is equal to or greater than the threshold value, the image display apparatus 100 may determine an image displayed in corresponding detailed areas as a dynamic image.

Figure 7B:
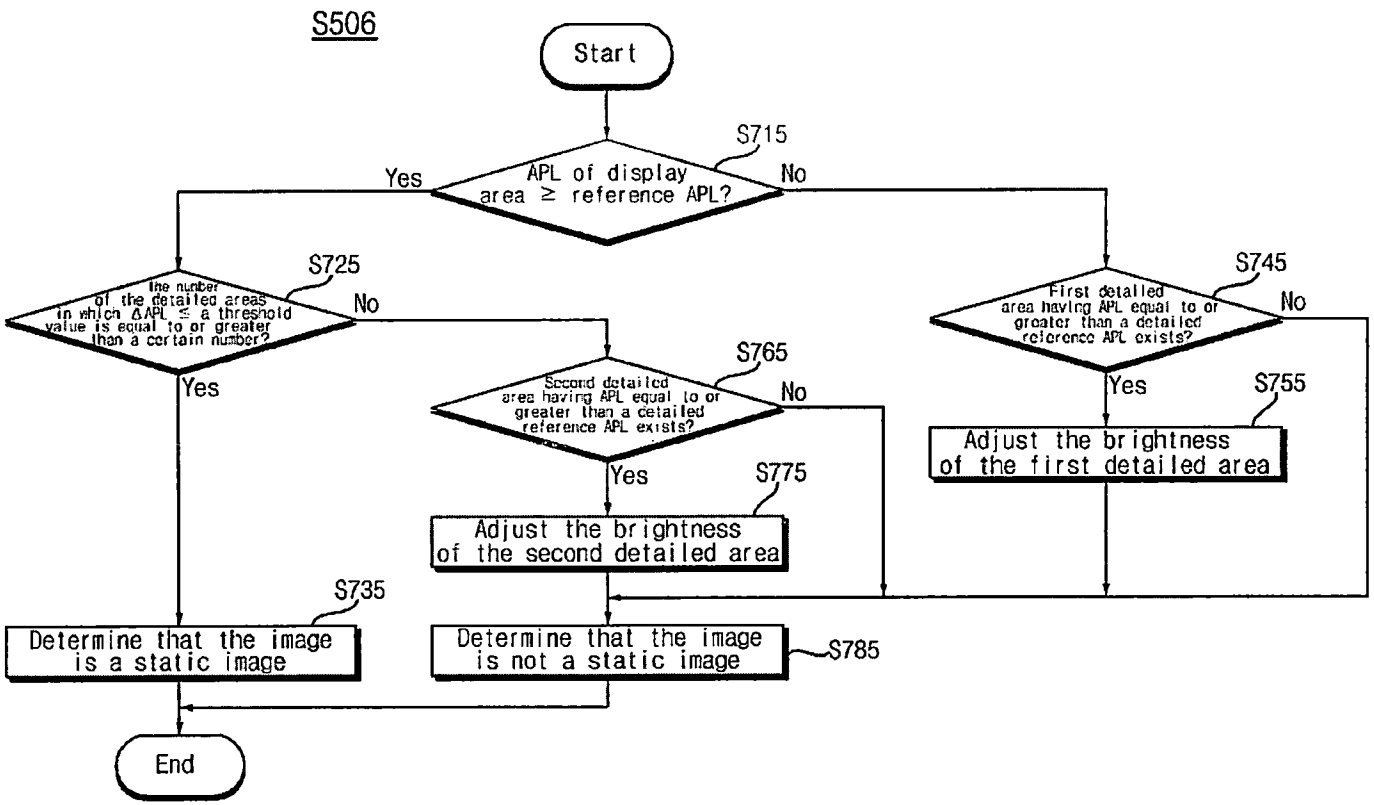

Meanwhile, according to FIG. 7B, even when the image displayed in the display area is not a static image having a high possibility of leaving afterimage, the image display apparatus 100 may reduce the possibility of occurrence of an afterimage. Detailed description of contents that overlap with those described in FIG. 7A will be omitted.

Referring to FIG. 7B, at operation S715, the image display apparatus 100 may calculate an APL for a display area which is exposed to the outside of the housing 10 of the display 180 to display an image, and may determine whether the APL for the display area is greater than or equal to the reference APL.

For example, the image display apparatus 100 may calculate the APL for each of a plurality of detailed area, and may determine whether the APL for the display area is greater than or equal to the reference APL, based on the calculated APL for each of a plurality of detailed areas.

At operation S745, when the APL for the display area is less than the reference APL, the image display apparatus 100 may determine whether at least one first detailed area having an APL equal to or greater than a certain detailed reference APL exists, among a plurality of detailed areas. Here, the detailed reference APL may be a value (e.g. 60%) higher than the reference APL (e.g. 50%).

At operation S755, when at least one first detailed area having an APL equal to or greater than a certain detailed reference APL exists, among a plurality of detailed areas, the image display apparatus 100 may adjust the brightness of the first detailed area so that the brightness of the first detailed area is lowered according to a preset reference.

For example, the image display apparatus 100 may control the display 180 so that the APL of the first detailed area becomes lower than the detailed reference APL.

Meanwhile, at operation S725, when the APL for the display area is greater than or equal to the reference APL, the image display apparatus 100 may calculate a first APL for each of a plurality of detailed areas included in the display area, and calculate a second APL according to a preset time or a preset frame.

In this case, the image display apparatus 100 may determine whether the number of second detailed area in which a difference (ΔAPL) between the first APL and the second APL is less than a threshold value (e.g. 5), which is calculated for each of a plurality of detailed areas included in the display area, is greater than or equal to a reference number (e.g. 10).

Meanwhile, when calculating the APL for each of a plurality of detailed areas at operation S715, the image display apparatus 100 may determine the APL calculated at operation S715 as the first APL, and may calculate only the second APL according to a preset time or a preset frame at operation S725.

At operation S735, among a plurality of detailed areas, when the number of second detailed area in which a difference (ΔAPL) between the first APL and the second APL is less than a threshold value is greater than or equal to a reference number, the image display apparatus 100 may determine that the image displayed in the display area is a static image having a high possibility of leaving afterimage.

Meanwhile, at operation S765, among a plurality of detailed areas, when the number of second detailed area in which a difference (ΔAPL) between the first APL and the second APL is less than a threshold value is less than a reference number, the image display apparatus 100 may determine whether at least one second detailed area having the second APL greater than or equal to the detailed reference APL exists.

At operation S775, among a plurality of detailed areas, when at least one second detailed area having the second APL greater than or equal to the detailed reference APL exists, the image display apparatus 100 may adjust the brightness of the second detailed area so that the brightness of the second detailed area is lowered according to a preset reference.

Meanwhile, at operation S785, when the APL for the display area is less than a reference APL, or when the number of the second detailed areas is less than a reference number, the image display apparatus 100 may determine that the image displayed in the display area is not a static image having a high possibility of leaving afterimage.

Referring to FIG. 5 again, at operation S507, when the image displayed in the display area corresponding to the first height h1 is a static image, the image display apparatus 100 may determine whether the static image is displayed for a certain time or longer.

When a certain time has not elapsed from the time point when the static image is displayed in the display area corresponding to the first height h1, the image display apparatus 100 may branch to operation S505 and continue to display the image in a corresponding area.

Meanwhile, at operation S508, when the static image is displayed in the display area corresponding to the first height h1 for a certain time or longer, the image display apparatus 100 may control the driving unit 175 so that the height of the display area exposed to the outside of the housing 10 reaches a third height h3. In this case, a difference h3−h1 between the third height h3 and the first height h1 may be smaller than the first height h1.

For example, the difference h3−h1 between the third height h3 and the first height h1 may correspond to a certain number of pixels (e.g. 30 pixels or less) disposed in the height direction.

The image display apparatus 100 may output an image through at least a portion of the display area corresponding to the third height h3, at operation S509.

Figure 9:
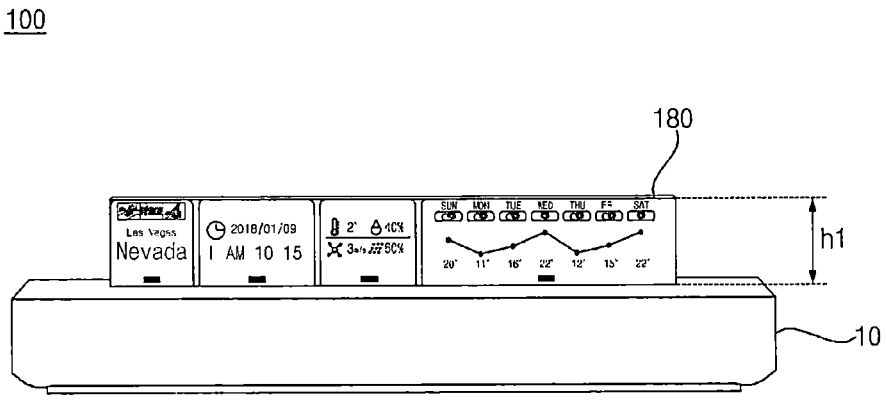

Referring to FIG. 9, a static image may be displayed over the entire display area corresponding to the first height h1 of the display 180. In this case, the image display apparatus 100 may determine whether the static image is displayed for a certain time or longer in the display area corresponding to the first height h1.

Figure 10A:
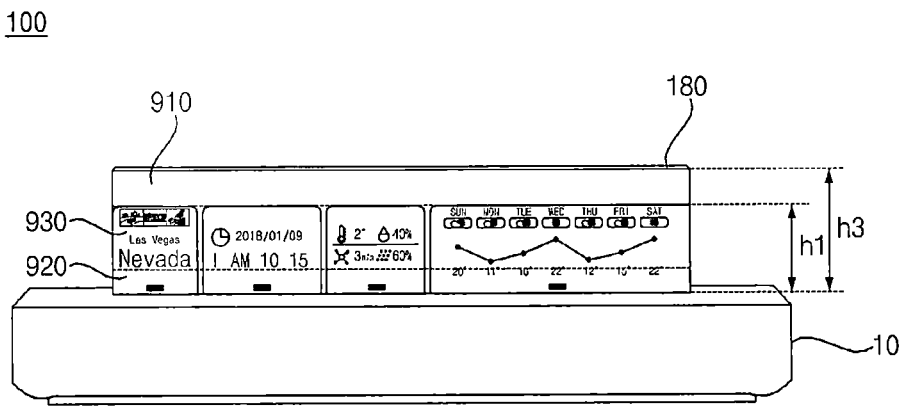

Referring to FIG. 10A, when the static image is displayed in the display area corresponding to the first height h1 for a certain time or longer, the height of the display area exposed to the outside of the housing 10 may be changed from the first height h1 to the third height h3.

The image display apparatus 100 may display a static image through a partial area corresponding to the first height h1 among the display area corresponding to the third height h3. In this case, a partial area corresponding to the first height h1 may include an area 920 exposed to the outside of the housing 10 while the height of the display area is changed from the first height h1 to the third height h3.

In other words, in the image display apparatus 100, as the display 180 is rolled up and the height of the display area exposed to the outside of the housing 10 is changed to the third height h3, the image is no longer displayed in the first area 910, in which an image is previously displayed, corresponding to the difference (h3−h1) between the third height h3 and the first height h1, and an image may be displayed in the second area 920 which is newly exposed to the outside of the housing 10. In addition, an image displayed in the remaining area 930 excluding the first area 910 and the second area 920 among the display area may be different from the existing one.

Accordingly, as the position at which the image is displayed on the display 180 is changed as a whole, a signal applied to each pixel included in the display panel is changed, thereby preventing the occurrence of an afterimage of a static image.

Referring to FIG. 5, at operation S510, the image display apparatus 100 may determine whether an image displayed through at least a portion of the display area corresponding to the third height h3 is a static image.

In this case, the image display apparatus 100 may determine whether the image displayed on the screen is a static image, in the same manner as or a similar to the operation of S506 and the operation of FIG. 7.

Figure 10B:
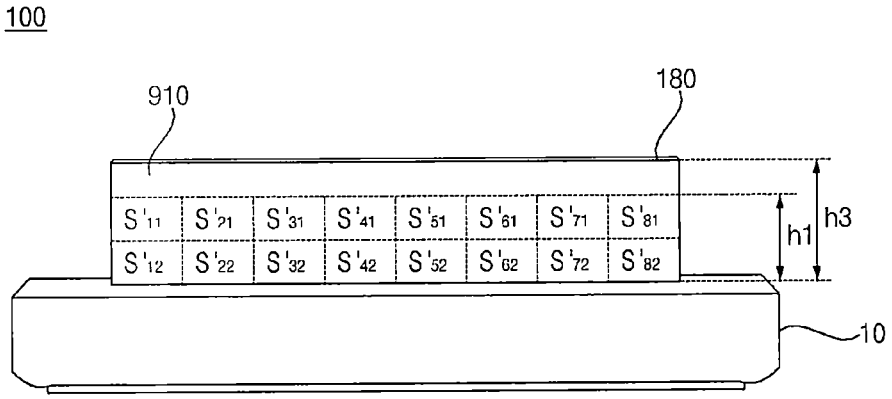

Referring to FIG. 10B, the image display apparatus 100 may determine whether the displayed image is a static image, based on the APL of the partial area corresponding to the height h1 and/or the APL of each of a plurality of detailed areas S11' to S82', without calculating the APL of the first area 910 corresponding to the difference h3–h1 between the third height h3 and the first height h1.

Figure 11:
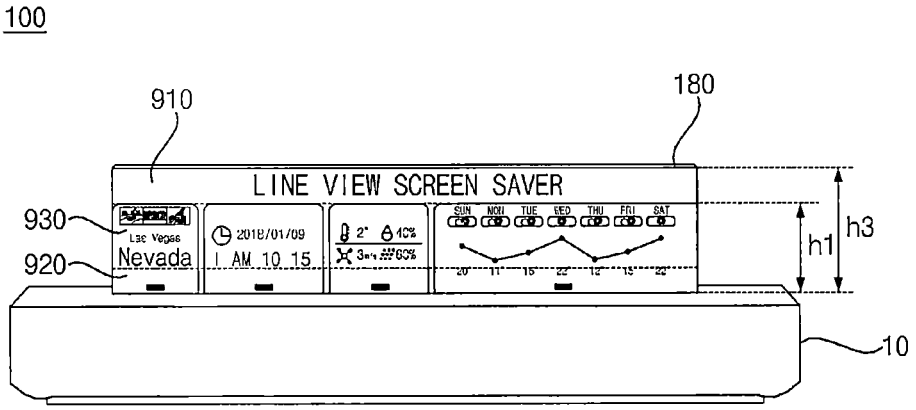

Meanwhile, referring to FIG. 11, the image display apparatus 100 may display an additional image in the first area 910 corresponding to a difference h3–h1 between the third height h3 and the first height h1. In this case, the additional image displayed on the first area 910 may include a message (e.g. LINE VIEW SCREEN SAVER) indicating the execution of a function of preventing the occurrence of an afterimage.

Meanwhile, the additional image displayed in the first area 910 may be a dynamic image. For example, the position of a message included in the additional image, which is displayed in the first area 910, may be repeatedly changed.

Figure 12A:
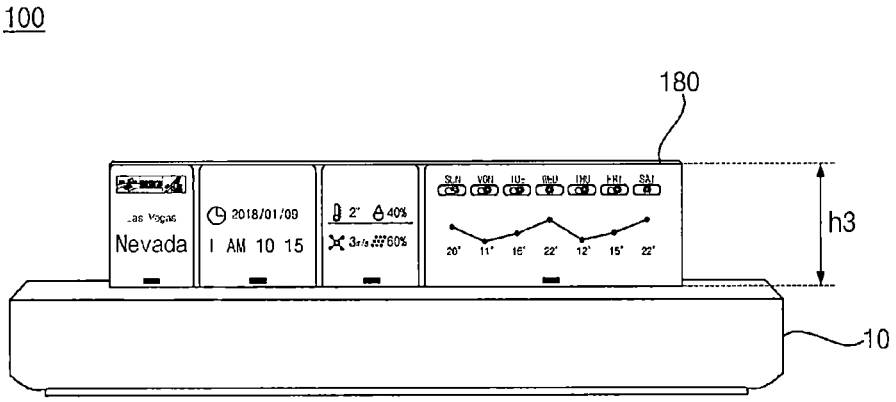

Meanwhile, referring to FIG. 12A, when a static image is displayed in the display area corresponding to the first height h1 for a certain time or longer, the height of the display area exposed to the outside of the housing 10 may be changed from the first height h1 to the third height h3, and a static image may be displayed through the entire display area corresponding to the third height h3.

In this case, the image display apparatus 100 may scale the static image displayed in the display area corresponding to the first height h1 to a size corresponding to the third height h3, and may display the static image scaled to the size corresponding to the third height h3 through the entire display area corresponding to the third height h3.

In other words, in the image display apparatus 100, as the display 180 is rolled up and the height of the display area exposed to the outside of the housing 10 is changed to the third height h3, the image previously displayed is scaled to a size corresponding to the third height h3, and thus a signal applied to each pixel included in the display panel is changed, thereby preventing the occurrence of an afterimage for a static image.

Figure 12B:
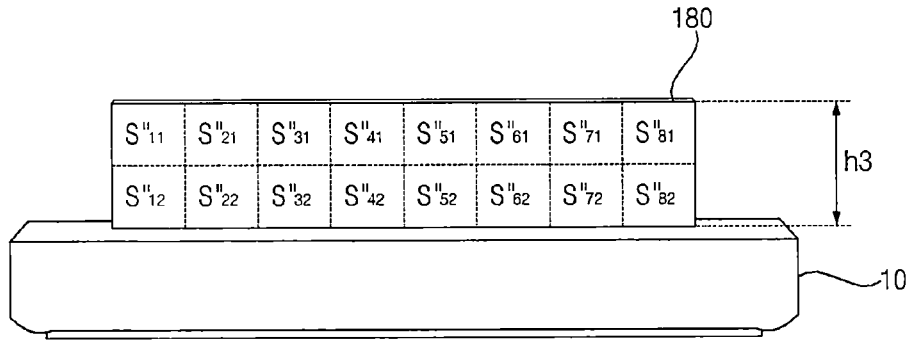

Further, referring to FIG. 12B, when the height of the display area is changed from the first height h1 to the third height h3, the image display apparatus 100 may determine whether the scaled and displayed image is a static image, based on the APL of each of a plurality of detailed areas S11" to S82" corresponding to the third height h3.

Referring to FIG. 5 again, when the image displayed through at least a portion of the display area corresponding to the third height h3 is not a static image, unlike operation S506, the image display apparatus 100 branches to operation S504 and may control the driving unit 175 so that the height of the display area exposed to the outside of the housing 10 reaches the first height h1 again.

That is, in the state where the height of the display area exposed to the outside of the housing 10 is the third height (h3), when the image displayed on the screen is not a static image, the first are 910 corresponding to the difference h3–h1 between the third height h3 and the first height h1 may be removed, by not maintaining the height of the display area at the third height h3, but immediately changing to the first height h1 and displaying an image.

Meanwhile, at operation S511, when the image displayed through at least a portion of the display area corresponding to the third height h3 is a static image, the image display apparatus 100 may determine whether the static image is displayed for a certain time or longer.

When a certain time is not elapsed from the time when the static image is displayed through at least a portion of the display area corresponding to the third height h3, the image display apparatus 100 may branch to operation S509 and continue to display the image in a corresponding area.

Meanwhile, at operation S511, when a static image is displayed in at least a portion of the display area corresponding to the third height h3 for a certain time or longer, the image display apparatus 100 may control the driving unit 175 so that the height of the display area exposed to the outside of the housing 10 reaches the first height h1.

Meanwhile, the image display apparatus 100 may continuously check whether the power of the image display apparatus 100 is turned off and whether the mode of the image display apparatus 100 is changed, while performing operations S504 to S511.

For example, when the mode of the image display apparatus 100 is changed to the full view mode while performing operations S504 to S511, the image display apparatus 100 immediately branches to operation S502, and may control the driving unit 175 so that the height of the display area exposed to the outside of the housing 10 reaches the second height h2.

As described above, according to various embodiments of the present disclosure, the signal applied to each pixel of the display panel can be changed, by changing the size of the display area exposed to the outside of the housing 10 among the entire area of the display 180 through the minimum movement of the display panel, and displaying an image in response to a change in the size of the display area, thereby preventing the occurrence of an afterimage and extending the life of the image display apparatus 100 and the display panel.

Figure 13:
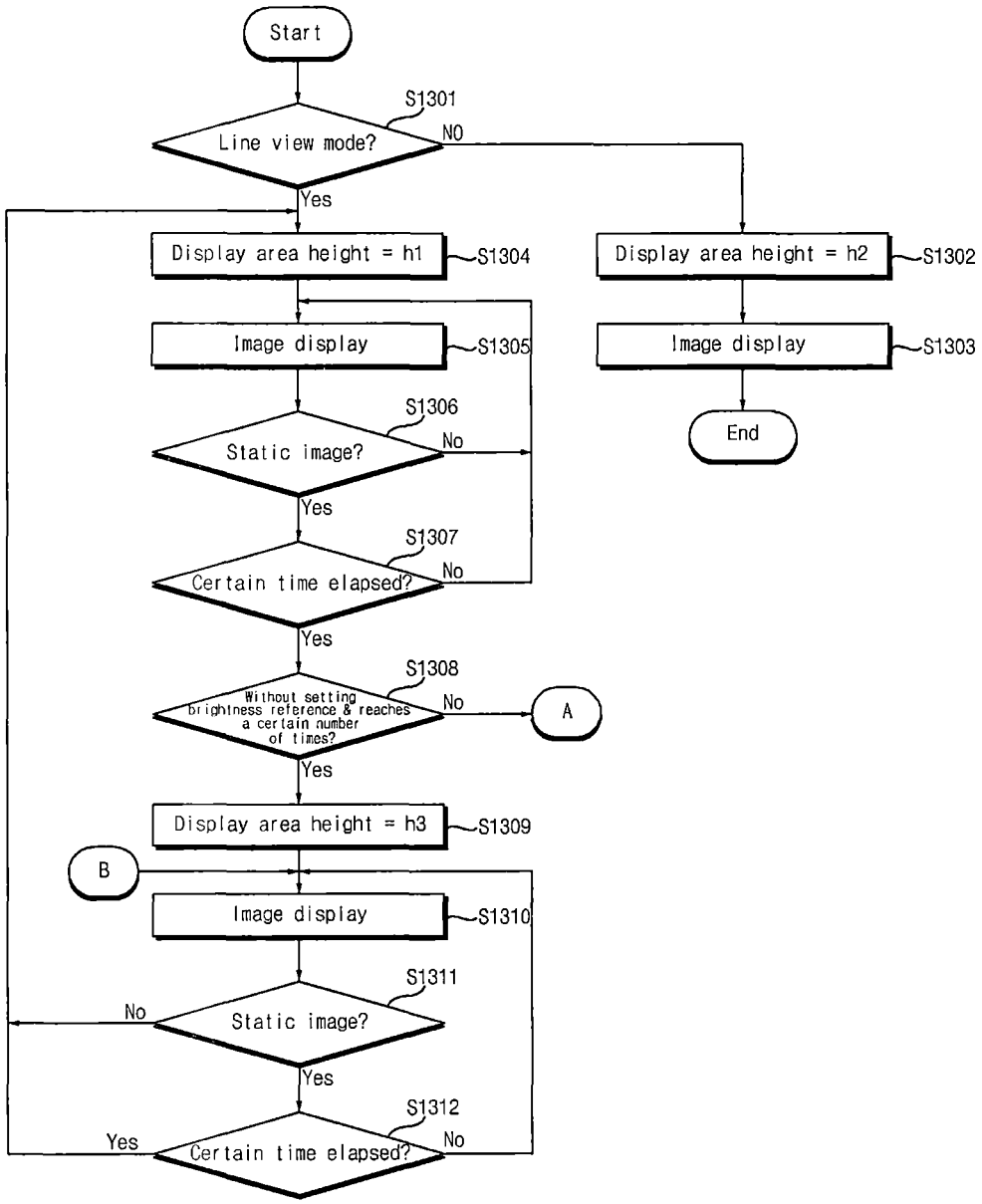
FIG. 13 is a flowchart illustrating a method of operating an image display apparatus according to another embodiment of the present disclosure.
Figure 14:
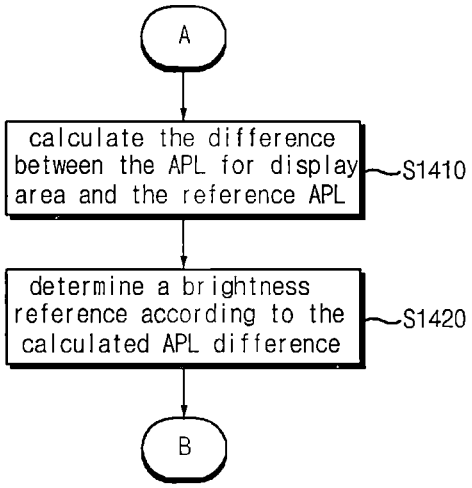
FIG. 14 is a flowchart illustrating a detailed operation method, relating to the method of operating the image display apparatus of FIG. 13.

FIG. 13 is a flowchart illustrating a method of operating an image display apparatus according to another embodiment of the present disclosure, and FIG. 14 is a flowchart illustrating a detailed operation method, relating to the method of operating the image display apparatus of FIG. 13. Detailed descriptions of contents overlapping with those described in FIGS. 5 and 7 will be omitted.

Referring to FIG. 13, at operation S1301, the image display apparatus 100 may check whether the mode of the image display apparatus 100 is a line view mode. For example, the image display apparatus 100 may determine a mode of the image display apparatus 100 according to a user input inputted through the user interface unit 150.

At operation S1302, when the mode of the image display apparatus 100 is a full view mode not a line view mode, the image display apparatus 100 may control the driving unit 175 so that the height of the display area exposed to the outside of the housing 10 reaches the second height h2.

In this case, the second height h2 may be a height corresponding to the entire area of the display 180.

The image display apparatus 100 may display an image through the entire area of the display 180, at operation S1303.

Meanwhile, at operation S1304, when the mode of the image display apparatus 100 is a line view mode, the image display apparatus 100 may control the driving unit 175 so that the height of the display area exposed to the outside of the housing 10 reaches the first height h1. For example, the first height h1 may be a height corresponding to ⅓ of the second height h2.

The image display apparatus 100 may output an image through a display area corresponding to the first height h1, at operation S1305.

The image display apparatus 100 may display a plurality of different images through the display area corresponding to the first height h1. In this case, the plurality of different images may all be static images, or at least one image may be a dynamic image.

At operation S1306, the image display apparatus 100 may determine whether the image displayed in the display area corresponding to the first height h1 is a static image. In this case, if the image is not a static image displayed in the display area corresponding to the first height h1, the image display apparatus 100 may branch to operation S1305 and continue to display the image.

In other words, when the image displayed in the display area corresponding to the first height h1 is not a static image having a high possibility of leaving afterimage, the image display apparatus 100 may continue to display the image.

Meanwhile, at operation S1307, when the image displayed in the display area corresponding to the first height h1 is a static image, the image display apparatus 100 may determine whether the static image is displayed for a certain time or longer.

When a certain time is not elapsed from the time point when the static image is displayed in the display area corresponding to the first height h1, the image display apparatus 100 may branch to operation S1305 and continue to display the image in a corresponding area.

Meanwhile, at operation S1308, when a static image is displayed in the display area corresponding to the first height h1 for a certain time or longer, the image display apparatus 100 may determine whether the number of times the size of the display area is changed reaches a certain number of times, without setting a reference (hereinafter, brightness reference) for adjusting the brightness of the display area.

For example, the image display apparatus 100 may determine whether the number of times the size of the display area is changed reaches a certain number of times (e.g. 5 times), as the height of the display area corresponding to the first height h1 is changed to the third height h3, or the height of the display area corresponding to the third height h3 is changed to the first height h1.

When a brightness reference is not set and the number of times the size of the display area is changed reaches a certain number of times, the image display apparatus 100 may set a brightness reference based on the APL for the display area, which will be described with reference to FIG. 14.

Referring to FIG. 14, at operation S1410, when the number of times the size of the display area is changed reaches a certain number of times (e.g. 5 times) in a state in which the brightness reference is not set, the image display apparatus 100 may calculate the difference between the APL for display area and the reference APL.

At this time, as shown in FIG. 7, when the APL for the display area is greater than or equal to the reference APL, it is determined that the image displayed in the display area is a static image having a high possibility of leaving an afterimage, and thus the size of the display area is changed. Therefore, the difference between the APL for the display area and the reference APL may be zero or more.

The image display apparatus 100 may determine a brightness reference, based on the difference between the APL for the display area and the reference APL, at operation S1420.

The image display apparatus 100 may determine a value obtained by dividing the difference between the APL for the display area and the reference APL by the number of steps of adjusting the brightness, the brightness reference, so that the brightness of the display area gradually decreases whenever the size of the display area is changed.

For example, when the difference between the APL for the display area and the reference APL is 15%, and the step of adjusting the brightness is step 5, the image display apparatus 100 may set the brightness reference to 3%.

Referring to FIG. 13 again, at operation S1309, the image display apparatus 100 may control the driving unit 175 so that the height of the display area exposed to the outside of the housing 10 reaches the third height h3. In this case, the difference h3−h1 between the third height h3 and the first height h1 may be smaller than the first height h1.

The image display apparatus 100 may output an image through at least a portion of the display area corresponding to the third height h3, at operation S1310.

In this case, when the brightness reference is set, the image display apparatus 100 may output an image according to the set brightness reference. For example, when the brightness reference is set to 3%, the image display apparatus 100 may display the image by adjusting the screen brightness of the display area so that the APL for the display area corresponding to the third height h3 becomes lowered by 3% than the APL for the display area corresponding to the previous first height h1

At operation S1311, the image display apparatus 100 may determine whether an image displayed through at least a portion of the display area corresponding to the third height h3 is a static image.

When the image displayed through at least a portion of the display area corresponding to the third height h3 is not a static image, the image display apparatus 100 branches to operation S1304, unlike operation S1306, the image display apparatus 100 may control the driving unit 175 so that the height of the display area exposed to the outside of the housing 10 reaches the first height h1 again.

Meanwhile, at operation S1312, when the image displayed through at least a portion of the display area corresponding to the third height h3 is a static image, the image display apparatus 100 determines whether the static image is displayed for a certain time or longer.

When a certain time is not elapsed from the time point when the static image is displayed through at least a portion of the display area corresponding to the third height h3, the image display apparatus 100 may branch to operation S1310 and continue to display the image in a corresponding area.

Meanwhile, at operation S1312, when the static image is displayed through at least a portion of the display area corresponding to the third height h3 for a certain time or longer, the image display apparatus 100 may control the driving unit 175 so that the height of the display area exposed to the outside of the housing 10 reaches the first height h1.

In this case, even when the height of the display area is changed from the third height h3 to the first height h1, and an image is displayed through the display area corresponding to the first height h1, if a brightness reference is set, the image display apparatus 100 may output an image by adjusting the screen brightness of the display area according to the set brightness reference.

Meanwhile, at operation S1306 and/or S1311, when it is determined that the image displayed through the display area is not a static image, the image display apparatus 100 may initialize the setting of the brightness reference.

Meanwhile, while performing operations S1304 to S1312, the image display apparatus 100 may continuously check whether the power of the image display apparatus 100 is turned off and whether the mode of the image display apparatus 100 is changed.

For example, when the mode of the image display apparatus 100 is changed to a full view mode while performing operations S1304 to S1312, the image display apparatus 100 immediately branches to operation S1302, and may control the driving unit 175 so that the height of the display area exposed to the outside of the housing 10 reaches the second height h2. As described above, according to various embodiments of the present disclosure, if the display of the static image continues, it is possible to more effectively prevent the occurrence of afterimage by gradually lowering the screen brightness, together with the size change of the display area.

According to at least one embodiment of the present disclosure, it is possible to prevent the occurrence of afterimage and extend the life of the image display apparatus, by changing the size of an area exposed to the outside of the entire area of the display through movement of the display panel, and displaying an image in response to the change in the size of the area exposed to the outside.

Since the accompanying drawings are merely for easily understanding embodiments disclosed herein, it should be understood that the technical spirit disclosed herein is not limited by the accompanying drawings, and all changes, equivalents or substitutions are included in the spirit and technical scope of the present disclosure.

Likewise, although operations are shown in a specific order in the drawings, it should not be understood that the operations are performed in the specific order shown in the drawings or in a sequential order so as to obtain desirable results, or all operations shown in the drawings are performed. In certain cases, multitasking and parallel processing may be advantageous.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical spirit or scope of the present disclosure.

What is claimed is:

1. An image display apparatus comprising:

a housing;

a display configured to display an image;

a driving unit configured to change a size of an exposed display area of the display outside of the housing; and a controller configured to:

when the size of the exposed display area is smaller than a size of an entire area of the display, determine whether an image displayed on at least a portion of the exposed display area is a static image, cause the driving unit to change the size of the exposed display area based at least in part on the image being displayed for a certain time period when the image is the static image, and cause the display to continue to display the image in response to a change in the size of the exposed display area.

2. The image display apparatus of claim 1, wherein the driving unit comprises a roller disposed inside the housing, wherein the display comprises a flexible display panel wound around or unwound from the roller, and wherein the controller is further configured to cause the flexible display panel to be rolled up or rolled down according to a rotation of the roller such that the size of the exposed display area is changed.

3. The image display apparatus of claim 2, wherein the controller is further configured to:

control the driving unit such that a height of the exposed display area reaches a second height higher than a first height based at least in part on the image being displayed past the certain time period in a state in which the height of the exposed display area corresponds to the first height, and cause the display to display the image through a partial area corresponding to the first height, wherein the partial area comprises an area exposed outside of the housing when the height of the exposed display area reaches the second height from the first height.

4. The image display apparatus of claim 3, wherein the controller is further configured to:

control the driving unit such that the height of the exposed display area reaches the first height based at least in part on the image being displayed past the certain time period in a state in which the height of the exposed display area corresponds to the second height, and cause the display to display the image through the exposed display area with the first height.

5. The image display apparatus of claim 2, wherein the controller is further configured to:

control the driving unit such that a height of the exposed display area reaches a second height higher than a first height based at least in part on the image being displayed past the certain time period in a state in which the height of the exposed display area corresponds to the first height, scale the image to the second height, and cause the display to display the scaled image through the exposed display area with the second height.

6. The image display apparatus of claim 5, wherein the controller is further configured to:

control the driving unit such that the height of the exposed display area reaches the first height based at least in part on the scaled image being displayed past the certain time period in a state in which the height of the exposed display area corresponds to the second height, and cause the display to display the image through the exposed display area with the first height.

7. The image display apparatus of claim 3, wherein the controller is configured to:

determine a first average picture level (APL) for each of a plurality of detailed areas from an area in which an image is displayed among the exposed display area, and determine that the image is not the static image based at least in part on an APL of the area in which the image is displayed being less than a certain reference value according to the first APL for each of the plurality of detailed areas.

8. The image display apparatus of claim 5, wherein the controller is configured to:

determine a first average picture level (APL) for each of a plurality of detailed areas from an area in which an image is displayed among the exposed display area, and determine that the image is not the static image based at least in part on an APL of the area in which the image is displayed being less than a certain reference value according to the first APL for each of the plurality of detailed areas.

9. The image display apparatus of claim 8, wherein the controller is further configured to:

determine whether at least one first detailed area with a corresponding first APL greater than or equal to a certain detailed reference value exists when the APL of the area in which the image is displayed is less than the certain reference value, and decrease a brightness of the first detailed area according to a preset reference based at least in part on a determination that the first detailed area exists.

10. The image display apparatus of claim 9, wherein the controller is further configured to:

determine a second APL for each of the plurality of detailed areas according to a preset time or a preset frame when the APL of the area in which the image is displayed is greater than or equal to the certain reference value, and determine that the image is the static image when a number of second detailed areas in which a difference between a corresponding first APL and a corresponding second APL is less than a preset threshold value is greater than or equal to a certain number.

11. The image display apparatus of claim 10, wherein the controller is further configured to:

determine whether the corresponding second APL of a second detailed area is greater than or equal to the certain detailed reference value, and lower a brightness of the second detailed area with a corresponding second APL equal to or greater than the certain detailed reference value according to the preset reference.

12. The image display apparatus of claim 7, wherein the controller is further configured to lower a brightness of the exposed display area according to a certain brightness reference in response to a change in the size of the exposed display area based on a frequency in change of the size of the exposed display area exceeds a threshold.

13. The image display apparatus of claim 12, wherein the controller is further configured to:

determine a difference between an APL of the area in which the image is displayed and the certain reference value when the frequency that the size of the exposed display area changes exceeds the threshold, wherein the certain brightness reference is determined according to the determined difference.

14. The image display apparatus of claim 3, wherein the controller is further configured to cause the display to display an additional image in a remaining area excluding a partial area corresponding to the first height among the exposed display area with the second height, wherein the additional image is a dynamic image.

15. The image display apparatus of claim 14, wherein the additional image comprises a message for performing a function of preventing occurrence of afterimage.

16. A method of operating an image display apparatus, the method comprising:

determining whether an image displayed through at least a portion of an exposed display area is a static image when the exposed display area is smaller than a size of an entire area of the display, wherein the exposed display area is outside of a housing of the image display apparatus;

changing the size of the exposed display area based at least in part on the image being displayed for a certain time period when the image is the static image; and displaying the image in response to a change in the size of the display area.

* * * * *